US007665530B2

(12) United States Patent
Wells et al.

(10) Patent No.: US 7,665,530 B2
(45) Date of Patent: Feb. 23, 2010

(54) TUBULAR GRIPPERS AND TOP DRIVE SYSTEMS

(75) Inventors: Lawrence E. Wells, Yorba Linda, CA (US); Neil Edward West, Corona, CA (US)

(73) Assignee: National Oilwell Varco L.P., Houston, TX (US)

( * ) Notice: Subject to any disclaimer, the term of this patent is extended or adjusted under 35 U.S.C. 154(b) by 158 days.

(21) Appl. No.: 11/982,844

(22) Filed: Nov. 3, 2007

(65) Prior Publication Data

US 2008/0135228 A1 Jun. 12, 2008

Related U.S. Application Data

(60) Provisional application No. 60/874,307, filed on Dec. 12, 2006.

(51) Int. Cl.

| | |
|---|---|
| ***E21B 19/16*** | (2006.01) |
| ***E21B 3/00*** | (2006.01) |
| ***E21B 3/02*** | (2006.01) |
| ***B25B 13/34*** | (2006.01) |
| ***E21B 31/12*** | (2006.01) |

(52) U.S. Cl. ..... 166/377; 166/77.51; 173/164; 294/86.1; 294/86.15; 81/57.33

(58) Field of Classification Search ..... 166/377, 166/77.51; 173/164; 294/86.1, 86.15; 81/57.33
See application file for complete search history.

(56) References Cited

U.S. PATENT DOCUMENTS

| | | | | |
|---|---|---|---|---|
| 3,086,413 A | | 4/1963 | Mason | |
| 3,902,385 A | | 9/1975 | Haby | 81/57.34 |
| 4,346,629 A | | 8/1982 | Kinzbach | 81/57.2 |
| 4,401,000 A | | 8/1983 | Kinzbach | 81/57.2 |
| 4,449,596 A | | 5/1984 | Boyadjieff | 175/85 |
| 4,458,768 A | | 7/1984 | Boyadjieff | 175/85 |
| 4,753,300 A | | 6/1988 | Shaw et al. | 173/164 |
| 4,800,968 A | | 1/1989 | Shaw et al. | 175/85 |
| 4,813,493 A | | 3/1989 | Shaw et al. | 173/164 |
| 4,821,814 A | * | 4/1989 | Willis et al. | 173/164 |
| 4,867,236 A | * | 9/1989 | Haney et al. | 166/77.51 |
| 4,878,546 A | | 11/1989 | Shaw et al. | 173/163 |
| 5,388,651 A | | 2/1995 | Berry | 175/85 |
| 5,433,279 A | | 7/1995 | Tessari et al. | 172/213 |
| 6,276,450 B1 | * | 8/2001 | Seneviratne | 166/85.1 |
| 6,536,520 B1 | | 3/2003 | Snider et al. | 166/78.1 |
| 6,679,333 B2 | | 1/2004 | York et al. | 166/379 |

(Continued)

OTHER PUBLICATIONS

PCT/GB2007/050691: Int'l Search Report; 4pp. (Counterpart of U.S. Appl. No. 11/982,844).

(Continued)

*Primary Examiner*—Jennifer H Gay
*Assistant Examiner*—Michael Wills, III
(74) *Attorney, Agent, or Firm*—Williams, Morgan & Amerson, P.C.

(57) ABSTRACT

A tubular gripping system and a top drive drilling system with such a tubular gripping system, in at least some aspects, the gripping system beneath the top drive unit and, in at least some aspects, the gripping system having a body with four spaced-apart grippers movably connected thereto and piston/cylinder devices movably interconnected with each gripper for moving the grippers to clamp the tubular.

11 Claims, 12 Drawing Sheets

U.S. PATENT DOCUMENTS

| | | | | |
|---|---|---|---|---|
| 6,684,737 | B1 * | 2/2004 | Schulze-Beckinghausen et al. | 81/57.33 |
| 6,705,405 | B1 | 3/2004 | Pietras | 166/380 |
| 7,055,594 | B1 | 6/2006 | Springett et al. | 166/85.1 |
| 7,281,451 | B2 | 10/2007 | Schulze Beckinghausen | 81/57.34 |
| 7,438,127 | B2 * | 10/2008 | Lesko | 166/85.1 |
| 2005/0269072 | A1 | 12/2005 | Folk et al. | 166/90.1 |

OTHER PUBLICATIONS

PCT/GB2007/050691: Written Opinion of Int'l Searching Authority: 6pp.

* cited by examiner

FIG. 3A
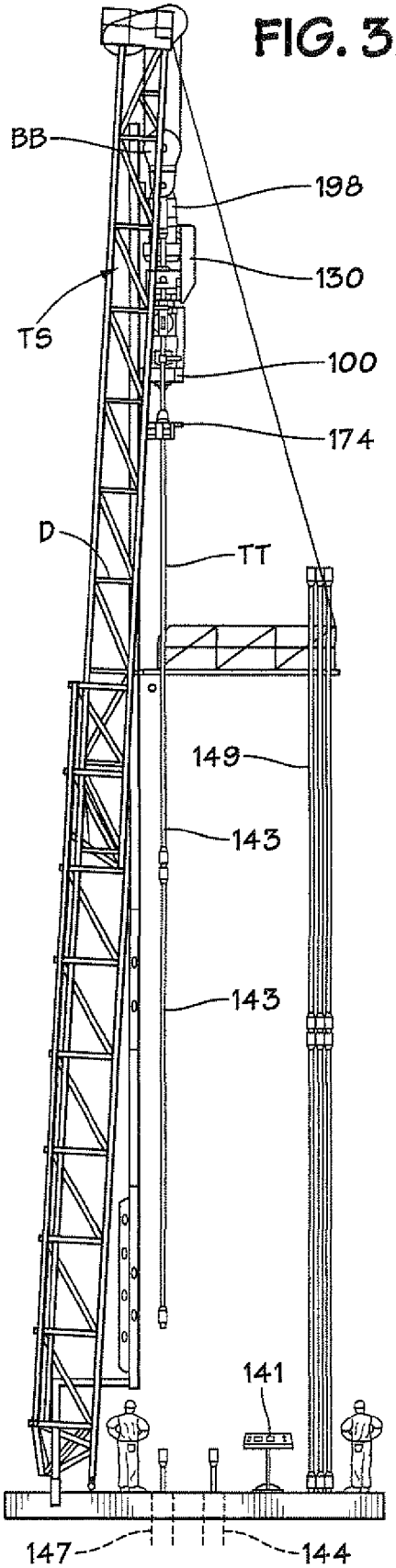
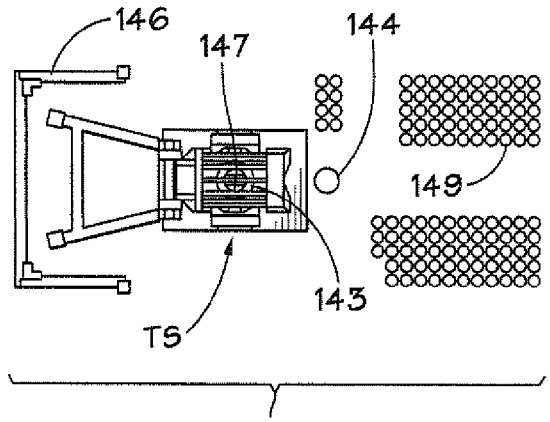
FIG. 3B
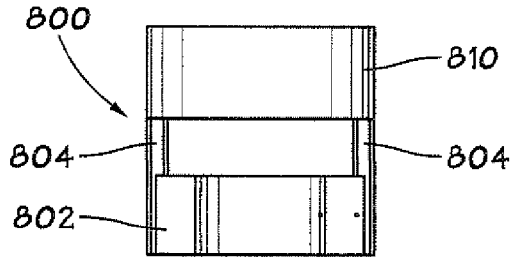
FIG. 6

TUBULAR GRIPPERS AND TOP DRIVE SYSTEMS

CROSS-REFERENCE TO RELATED APPLICATIONS

This application claims priority under 35 U.S.C. of U.S. application Ser. No. 60/874,307 filed Dec. 12, 2006, which is incorporated herein in its entirety.

BACKGROUND OF THE INVENTION

1. Field of the Invention

This present invention is directed to tubular grippers, clamping apparatuses, top drive systems, and methods of their use.

2. Description of Related Art

The prior art discloses a variety of tubular gripper systems and top drives used with such systems. Certain prior art top drive systems have a top drive unit and a pipe gripper system for receiving a tubular member and engageable jaws for contacting and gripping a tubular that has been positioned within the gripper system. In one aspect each jaw has an interconnected hydraulic cylinder apparatus which is controlled and activated to move the jaw into or out of gripping engagement with a tubular.

The prior art patents reveal a wide variety of such systems, including, but not limited to, and by way of example only, those disclosed in U.S. Pat. No. 7,055,594 and in the references cited in this patent and those disclosed in U.S. Pat. Nos. 2,950,639; 3,902,385; 4,346,629; 4,458,768; 5,433,279; 6,276,450; 4,813,493; 6,705,405; 4,800,968; 4,878,546; 4,753,300; 6,536,520; 6,679,333.

U.S. Pat. No. 7,055,594 discloses pipe gripper and top drive systems, and, in certain aspects, a top drive drilling system, in at least some aspects, having a top drive unit, and a pipe gripping system beneath the top drive unit which has an open throat for receiving a tubular to be gripped by the pipe gripping system; and, in at least certain aspects, the gripping system having a body with first and second jaws movably connected thereto and piston/cylinder devices movably interconnected with each jaw for moving the jaws to clamp and then to rotate the pipe. In one aspect, a pipe gripping system is disclosed which has a body, a first jaw movably connected to the body, a second jaw movably connected to the body, a first piston/cylinder device movably interconnected with the first jaw, a second piston/cylinder device movably interconnected with the second jaw, the first piston/cylinder device for moving the first jaw to clamp a pipe and the second piston/cylinder device for moving the second jaw to clamp the pipe, and the first piston/cylinder device for moving the first jaw and the second piston/cylinder device for moving the second jaw to rotate the pipe.

U.S. Pat. No. 7,281,451 discloses methods and apparatus for making and breaking tubular connections within a tubular string are disclosed. In certain aspects, a tong assembly includes gated power and back up tongs coupled to a torque bar. Jaws of the tongs may be arranged circumferentially with support members disposed between adjacent jaws to substantially complete a 360 degree closed circle. A hydraulic circuit may equally distribute fluid and pressure to actuate the jaws. The power tong may include a gated rotor driven by at least three drive motors. The rotor may be selectively physically locked from rotation or movement by one or more rotor locks. Further, the tong assembly may include an interlock that prevents activation of the drive motors until the rotor locks actuate to unlock the rotor. Additionally, gate locks may secure the tongs and rotor when closed, and a releasable coupling arrangement may aid engagement of a motor to a rotor pump. There is disclosed an apparatus for handling a first tubular and a second tubular during make up and break out operations, including: a tong having jaws radially arranged within a rotatable member and moveable toward a center for gripping the first tubular, wherein each jaw is actuated by a substantially equal supply of fluid independently controlled by a common pressure limiter; and a back up member for gripping the second tubular and preventing rotation thereof.

U.S. Pat. No. 3,902,385 discloses pipe joint make-up or break-out tools for making or breaking a threaded pipe joint, including two gripping assemblies adapted to extend about and grip two pipe sections respectively and each having two jaws hinged together for opening and closing movement, with the two gripping assemblies being mounted for relative rotary movement about the pipe axis by power driven actuating means, preferably including two piston and cylinder mechanisms, each of which acts in one rotary direction against one of the gripping assemblies and in the opposite rotary direction against the other gripping assembly at essentially the location of the hinge between its two jaws. In one aspect a tool is disclosed for effecting relative rotation between two threaded pipes about an axis of the pipes, including: a first gripping assembly adapted to extend about and grip a first of the pipes, and including two jaws and a first hinge connection attaching the jaws together for relative swinging movement about a first hinge axis between open and closed positions; a second gripping assembly adapted to extend about and grip a second of the pipes, and including two additional jaws and a second hinge connection attaching the additional jaws together for relative swinging movement about a second hinge axis between open and closed positions; a power operated actuating unit for exerting force against the two gripping assemblies in a relation causing relative rotation between the pipes; the two hinge connections being receivable substantially in axial alignment with one another in a position in which the jaws of both gripping assemblies are openable; and a shoulder carried by a jaw of one of the gripping assemblies and engageable with a shoulder on a corresponding jaw of the other gripping assembly in a relation transmitting closing force from one jaw to the other when the two assembles are in the relative position in which they are openable.

BRIEF SUMMARY OF THE INVENTION

The present invention, in at least certain embodiments, teaches new tubular gripping systems and new top drive drilling systems with such a gripping system.

The present invention, in certain aspects, discloses tubular gripping systems with a body into which is receivable a tubular to be gripped, and four grippers for engaging a tubular to be gripped, the grippers movably connected to the body. In certain aspects the grippers are movable simultaneously. In certain aspects the body is a single piece; in other aspects the body is two separable halves.

In certain aspects, the present invention discloses top drive systems with: a top drive unit; a tubular gripping system connected to and beneath the top drive unit; the tubular gripping system having a body, a first gripper movably connected to the body, a second gripper movably connected to the body, a third gripper movably connected to the body, a fourth gripper movably connected to the body, a first piston/cylinder device movably interconnected with the first gripper, a second piston/cylinder device movably interconnected with the second gripper, a third piston/cylinder device movably interconnected with the third gripper, a fourth piston/cylinder device movably interconnected with the fourth gripper, and each piston/cylinder device for moving its respective gripper to clamp a tubular.

In certain aspects a top drive drilling system according to the present invention includes a joint handling system which, in one aspect, has a tubular gripper system according to the present invention which has a body into which a tubular member is received and four selectively engageable grippers for contacting and gripping a tubular that has been positioned within the body. In one aspect each gripper has an interconnected hydraulic cylinder apparatus which is selectively controlled and activated to move the gripper into and out of gripping engagement with a tubular or to move it out of gripping engagement with a tubular.

In one aspect apparatuses used to effect gripping of a tubular, e.g., but not limited to, hydraulic apparatuses, are controlled so that the grippers engage the tubular simultaneously.

In one aspect, the present invention discloses methods with a tubular gripping system for holding a first member and facilitating disconnection of the first member from a second member, the first member threadedly connected to the second member, the tubular gripping system having a body with a primary splined structure thereon, the first member having a secondary splined structure, the methods including: engaging the primary splined structure with the secondary splined structure; and thereby preventing rotation of the first member with respect to the tubular gripping system.

Accordingly, the present invention includes new and nonobvious features and advantages. Characteristics and advantages of the present invention described above and additional features and benefits will be readily apparent to those skilled in the art upon consideration of the following detailed description of preferred embodiments and referring to the accompanying drawings.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide new, useful, unique, efficient, nonobvious tubular gripper systems with four movable grippers, top drive drilling apparatuses with such systems, and methods of their use.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. This invention includes any legally equivalent devices or methods which do not depart from the spirit and scope of the present invention.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain embodiments and are not to be used to improperly limit the scope of the invention which may have other equally effective or legally equivalent embodiments.

FIG. 3A is a side view of a system according to the present invention with a tubular gripper according to the present invention.

FIG. 3B is a top view of the system of FIG. 3A.

FIG. 6 is a front view of a system according to the present invention.

Figure 1:
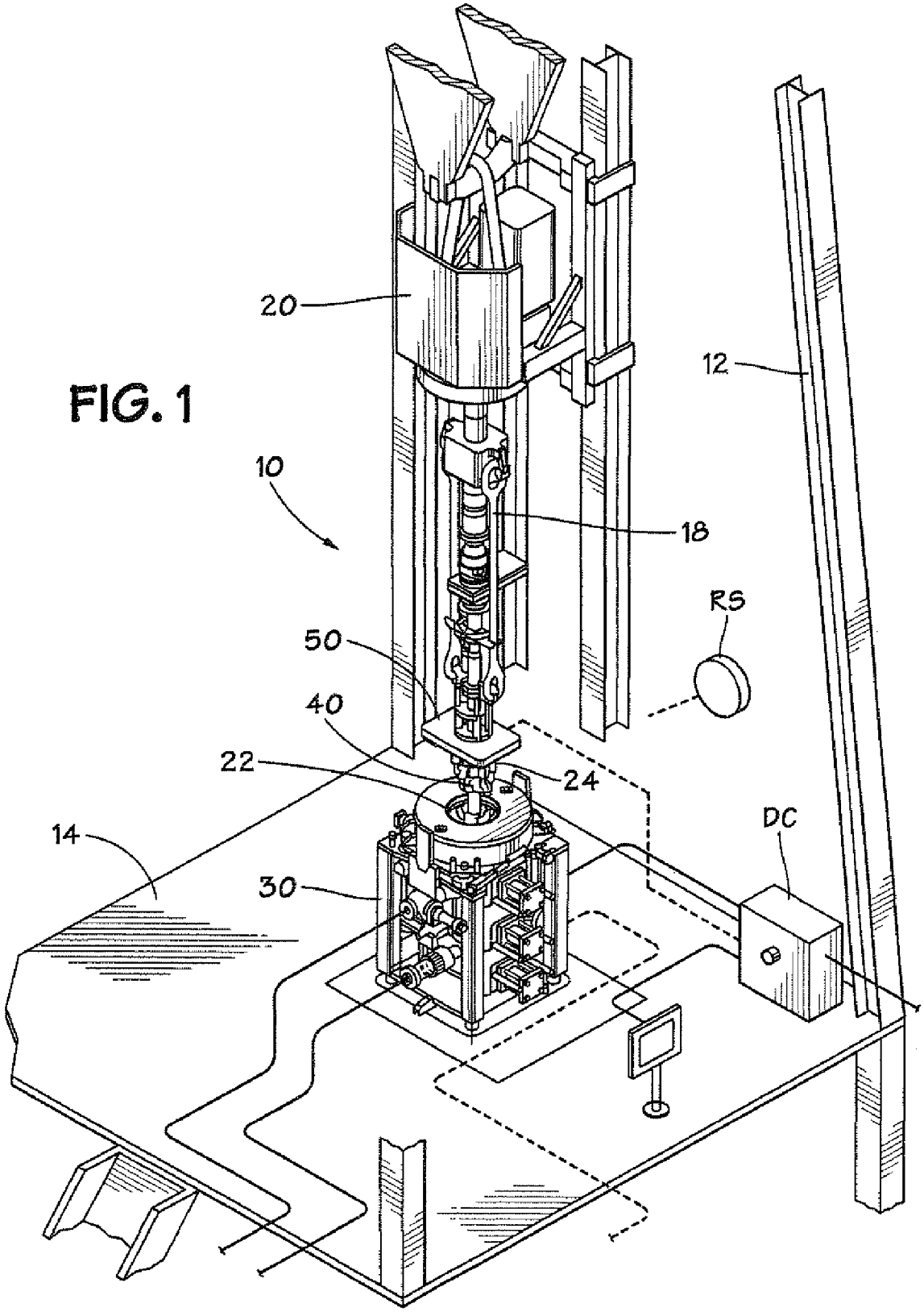
FIG. 1 is a perspective schematic view of a top drive system with a tubular gripper according to the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference.

DETAILED DESCRIPTION OF THE INVENTION

FIG. 1 shows a top drive drilling system 10 according to the present invention which includes a top drive drilling unit 20 suspended in a derrick 12. An optional continuous circulation system 30 rests on a rig floor 14 and part of a saver sub 22 projects up from the system 30. The saver sub 22 is connected to and rotated by the top drive 20. An elevator 40 is suspended below the top drive 20. A tubular gripper system 50 according to the present invention (shown schematically) is suspended from the top drive 20 and the elevator 40 is suspended from the tubular gripper system 50. Any suitable known elevator may be used with the tubular gripper system 50. The tubular gripper system 50 (any according to the present invention) is suspended from the top drive 20 with links 18 and the elevator 40 is suspended from the tubular gripper system with links 24.

Systems according to the present invention can use hydraulic power lines for an existing top drive and/or for other existing rig apparatuses (e.g., but not limited to, a pipe handler), an in-place driller's console DC, buttons, computer(s), and controls can be used to control the tubular gripper system according to the present invention. Alternatively a completely separate hydraulic power system and/or controls may be used; which, in one aspect, is a remote system RS.

A tubular gripping system according to the present invention may be used with systems as disclosed in pending U.S. application Ser. No. 11/140,462 filed May 28, 2005, Ser. No. 10/870,700 filed Jun. 16, 2004, Ser. No. 10/877,949 filed Jun. 24, 2004, Ser. No. 10/872,337 filed Jun. 18, 2004, and Ser. No. 10/862,787 filed Jun. 7, 2004, all incorporated fully herein for all purposes.

Figure 2A:
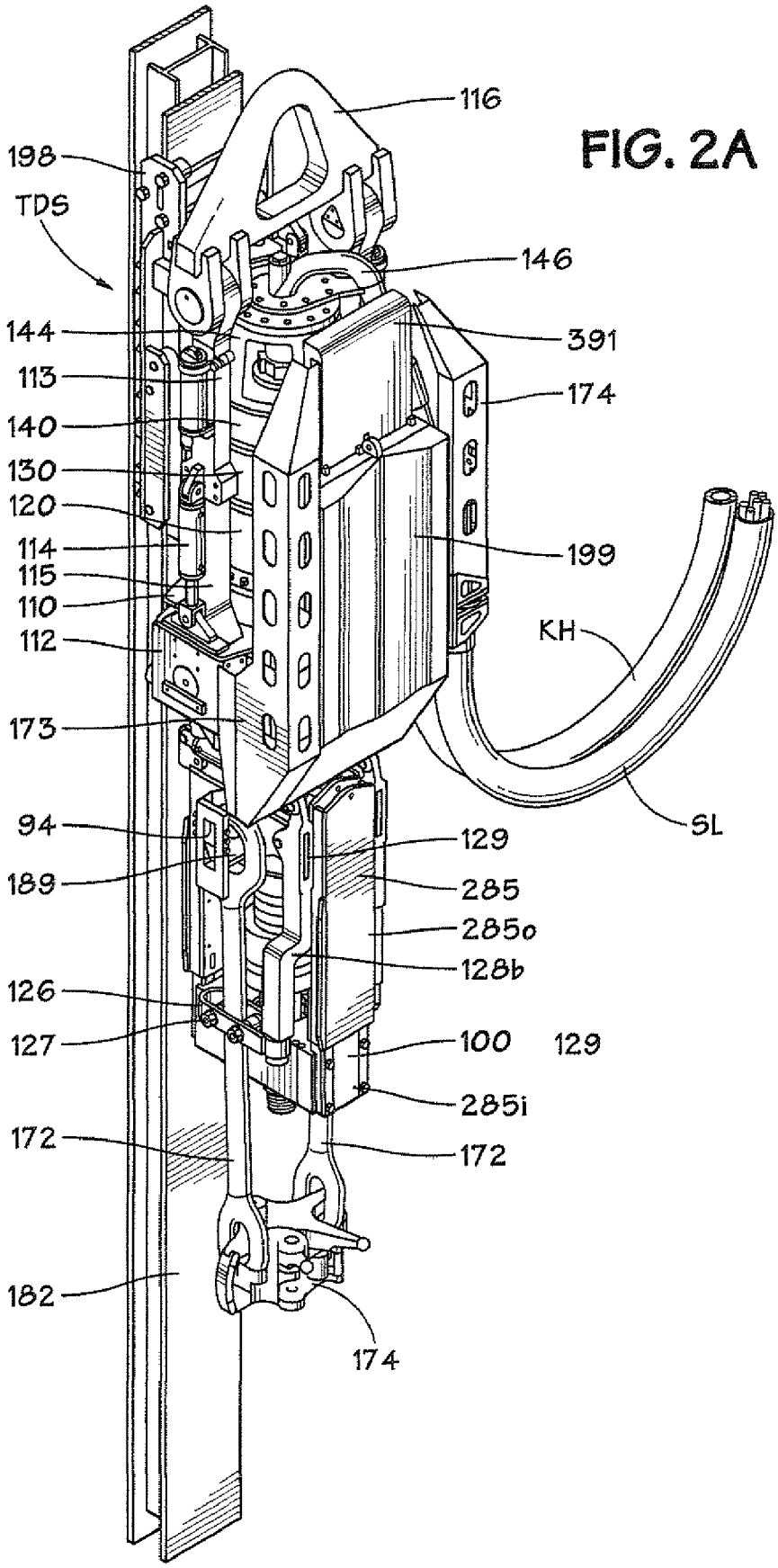
FIG. 2A is a perspective view of a top drive system according to the present invention with a tubular gripper system according to the present invention.
Figure 2B:
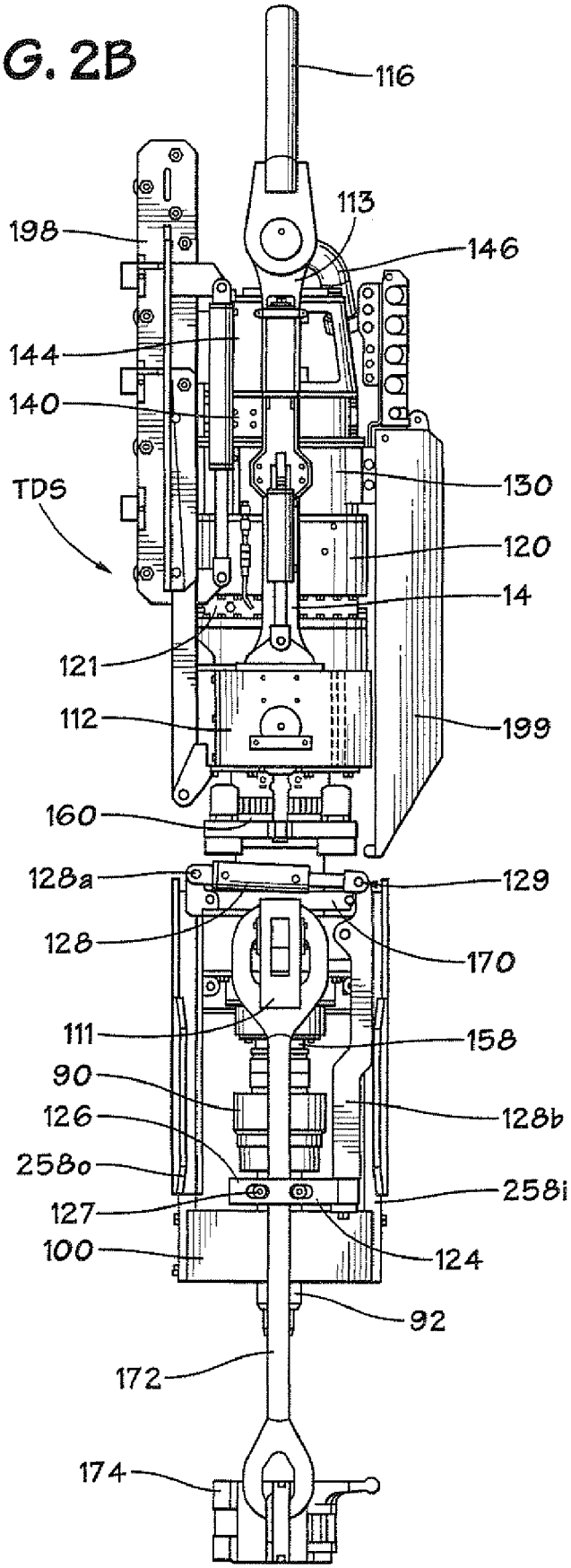
FIG. 2B is a side view of the system of FIG. 2A.

FIGS. 2A-2B show a top drive system TDS according to the present invention which has a swivel body 112 suspended with links 113 from a becket 116. The becket 116 is connected to a travelling block (not shown). A gear system 120 is mounted on a spacer plate 121 which is supported by the swivel body 112.

A motor 130 is coupled to the gear system 120. Any suitable motor may be used. A brake system 140 connected to the motor 130 is within a bonnet 144 through which extends a gooseneck 146 connected to a kelly hose KH (which is adjacent a service loop SL) through which flows drilling fluid. An extension system 198 provides horizontal displacement of the top drive system.

The motor 130 has an output shaft which drives a drive quill which extends through the motor 130, the gear system 120, the spacer plate 121, the swivel body 112, a locking system 160, and a load collar 170. A lower end 158 of the quill is threadedly connected to a mud saver system 90 which itself is connected to a saver sub 92. A system 100 according to the present invention for selectively gripping tubulars is suspended from the load collar 170. Links 172 suspend an elevator 174 from a link adapter 189.

A counterbalance system 110 (which can hold the weight of the entire system during stabbing of tubulars) includes two load compensators 114 each with an upper end connected to a link 113 and with a lower end connected to the swivel body 112. Each load compensator 114 includes a piston/cylinder assembly.

A link tilt system 129 provides selective tilting of the links 172 and thus selective movement and tilting of the elevator 174 and movement of a tubular or stand of tubulars supported by the elevator 174 to and away from a wellbore centerline. Bail retainers 94 retain the links 172 on the link adapter 189. Link tilt hydraulic cylinders 128 are interconnected pivotably between the load collar 170 (connected to ears 128*a*) and arms 128*b*. Each connector 124 is pivotably connected to a lower end of an arm 128*b* and to a clamp 126 which is clamped to a link 172. Optionally, roller pins 127 extend through the clamps 126 to facilitate movement of the links 172 within the clamps 126.

Guards 173 and 174 are on sides of an access platform 199. The access platform 199 is releasably connected to a rear guard at its top and pivotably at its lower portion to the guards so that it can pivot and be lowered to provide a platform on which personnel can stand to access various components on the rear guard. Optionally, the access platform may have an indented portion for facilitating the placement of tubulars thereon and for facilitating movement of tubulars on the exterior of the access platform.

The top drive system TDS can be movably mounted on a beam 182 (or "torque tube"). Horizontal displacement is provided by the extension system 198 which includes a torque bushing. The extension system 198 with the top drive system attached thereto is movable vertically on the beam 182 with the top drive system attached thereto. Each leg 285 is a telescoping leg with an outer part 285*o* and inner part 285*i*.

FIGS. 3A and 3B illustrate one installation of a top drive system TS according to the present invention in a derrick D. The top drive system TS is suspended from a block becket BB which is suspended from the derrick D in a typical manner. As shown in FIG. 3A, the elevator 174 is supporting a tubular stand TT which includes two pieces of drill pipe 143. The stand TT has been moved from a monkey board with multiple made-up stands 149 to a position axially aligned with a wellbore 147. A mousehole 144 may be used, e.g. to make stands. A driller controls drilling from a driller's panel 141.

Figure 4:
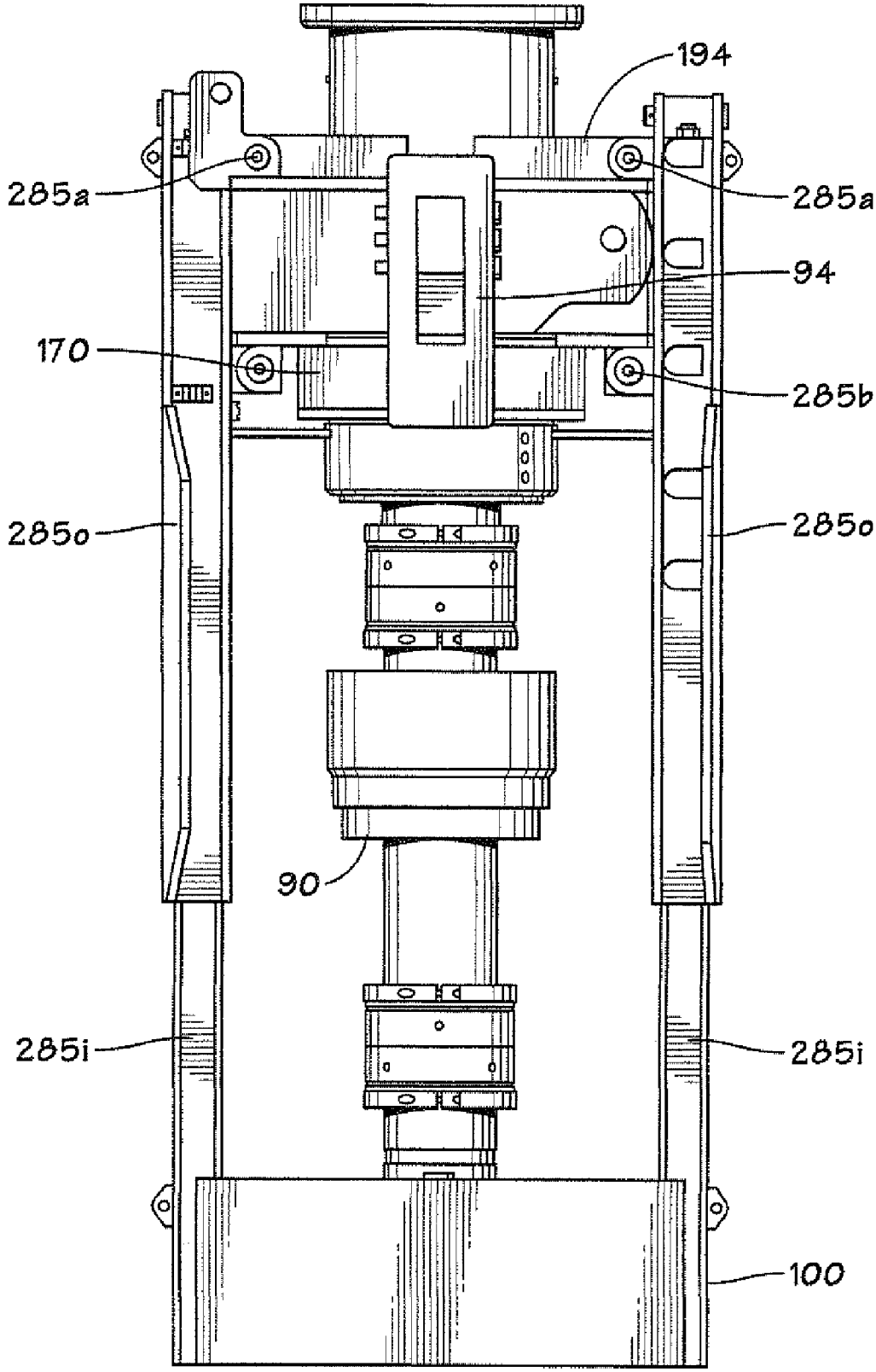
FIG. 4 is a front view showing a tubular gripping system according to the present invention in the system of FIG. 2A.

FIG. 4 illustrates the system 100 for selectively clamping tubulars, e.g. pipe or casing. The system 100 may be an integral apparatus or it may have two halves hingedly connected together. Top ends of outer leg part 285 of the system 100 are connected to connection structures of a the collar 194 with pins 285*a*, and with pins 285*b* to connection structures of the load collar 170; and the bottom ends of the inner leg parts 285*i* are bolted to the system 100. The inner leg parts 285*i* move within the outer leg parts 285*o* to provide a telescoping action that permits upward and downward motion of the system 100.

In one aspect the system 100 has dual opposed halves pinned together with removable pins so that the system 100 can be opened. Also, both halves can be unpinned permitting the legs to be moved apart allowing access to items on the legs and to other components of the system. In certain aspects the two halves are identical facilitating replacement and minimizing required inventory.

FIGS. 5A-5H show a top drive system 500 according to the present invention with a tubular gripper system 600 according to the present invention. A link adapter 502 beneath a motor/gear system 504 is connected to a load collar 512 and has links 506 which support an elevator 510. Telescoping legs 516 are connected to the tubular gripper system 600.

In one aspect the top drive system 500 includes an upper internal blowout preventer 522. A male spline member 524 with splines 524*a* on the upper internal blowout preventer 522 can be mated with a splined sleeve 604 with splines 604*a* between which are received the splines 524*a*. The tubular gripper system 600 can be lifted up on the legs 516 so that the splined sleeve 604 engages the male spline member 524 for use in breaking out a connection between a main shaft 528 of the top drive system and the upper internal blowout preventer 522. Following spinning off of the upper internal blowout preventer 522, the part of the tubular gripper system 600 on which the splined sleeve 604 is mounted supports the upper internal blowout preventer 522. The splined sleeve 604 is on one half 612 of the tubular gripper system 600 and, as described below, this half 612 can be swung out from under the top drive system so items supported by the gripper system, e.g. an entire valve stack or, e.g., as shown the upper internal blowout preventer 522 can be lifted away, e.g. with a tugger line.

Figure 5A:
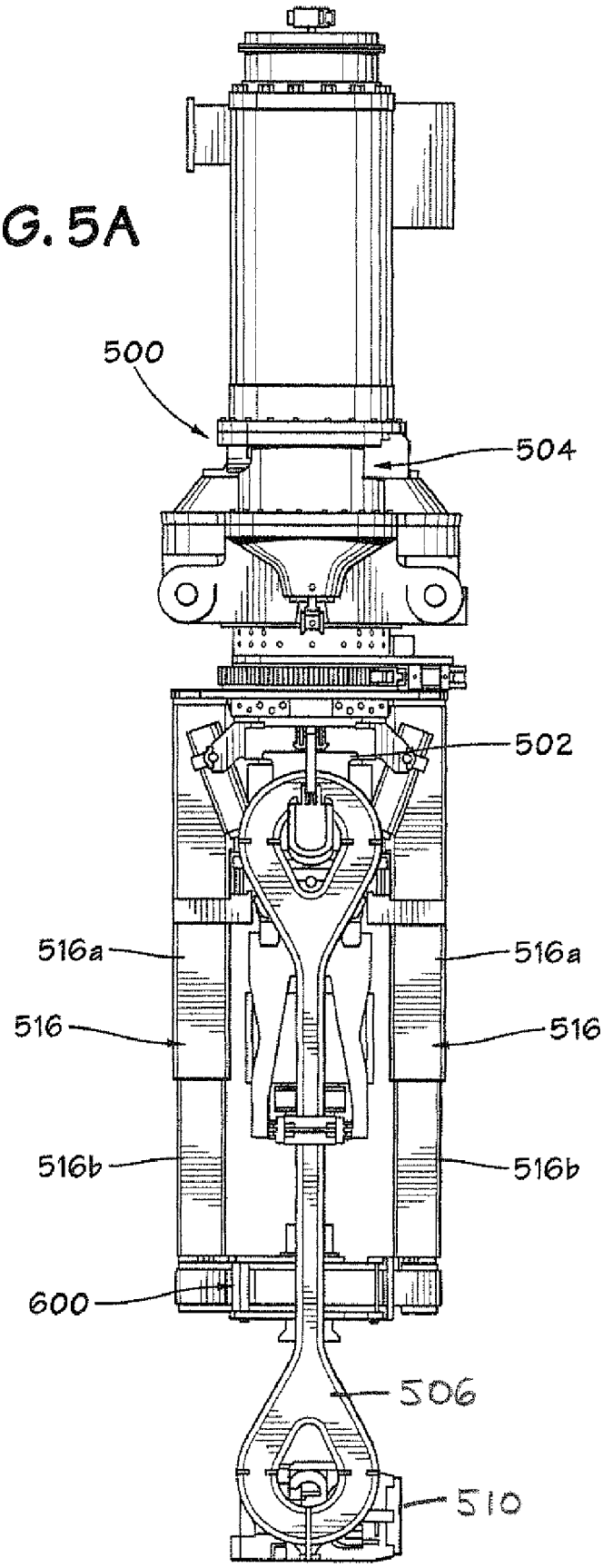
FIG. 5A is a side view of a top drive system according to the present invention with a tubular gripper system according to the present invention.
Figure 5B:
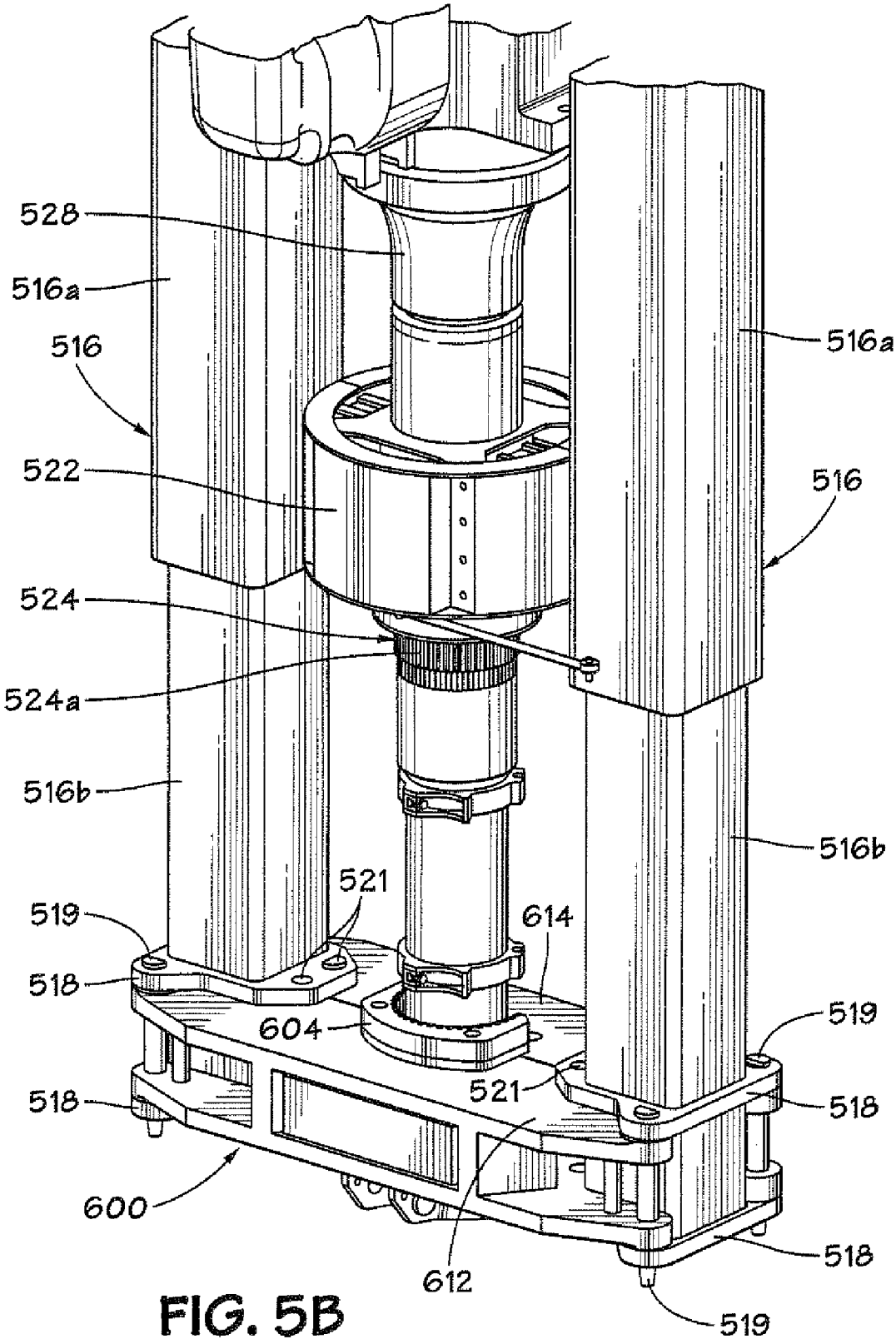
FIG. 5B is a top perspective view of part of the system of FIG. 5A.
Figure 5C:
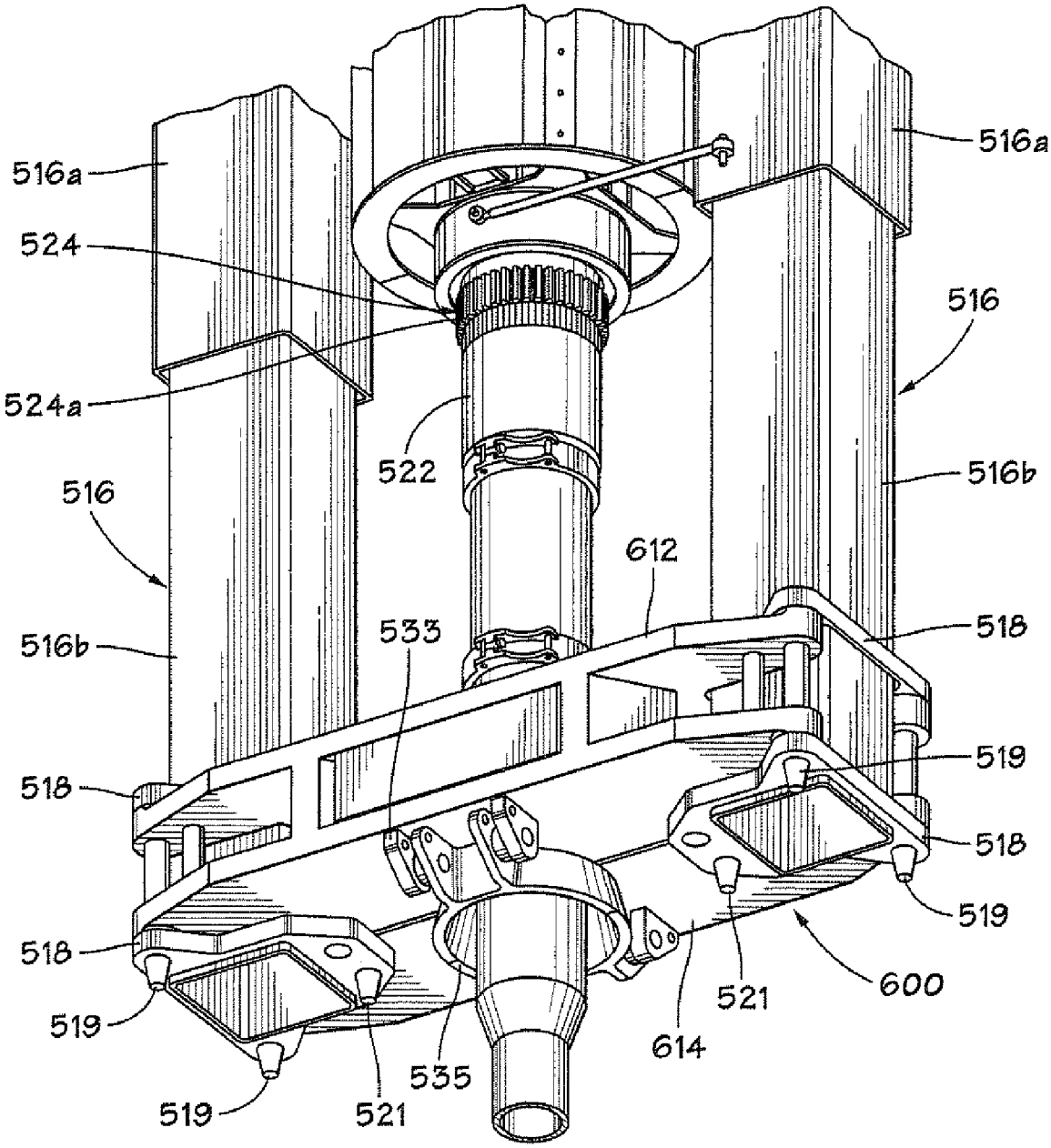
FIG. 5C is a bottom perspective view of part of the system of FIG. 5A.
Figure 5D:
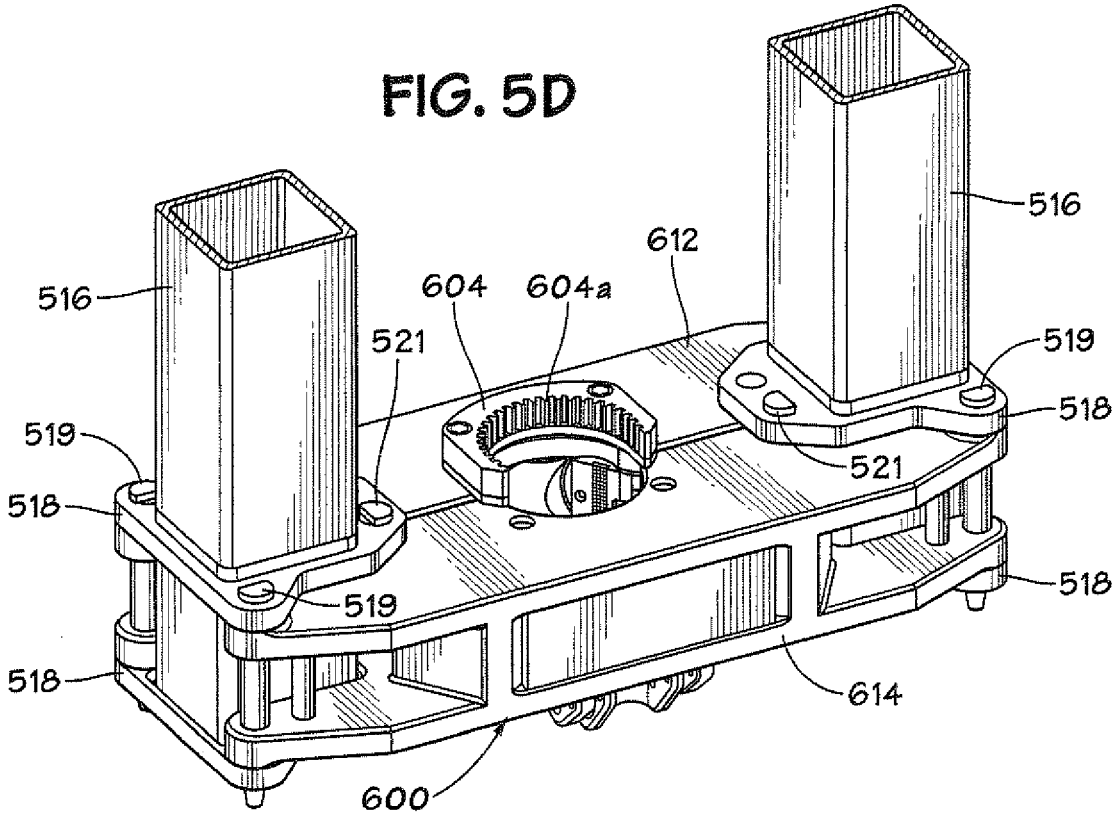
FIG. 5D is a perspective view of part of the system of FIG. 5A.

The tubular gripper system 600 has two halves 612, 614 each of which is pivotably pinned to leg mounts 518 of the legs 516 with a plurality of pins 519. Central pins 521 also pin the halves 612, 614 to the leg mounts 518. Removal of a pin 519 permits a half 612 or 614 of the tubular gripper system 600 to pivot about the remaining pin 519 (with the corresponding central pins 521 removed). With all pins removed the halves 612, 614 may be removed. As shown in FIG. 5D a pin 519 holding one end of the half 612 has been removed as well as the central pins 521 so that the half 612 can pivot about the remaining pin 519, while it supports the upper internal blowout preventer 522 which has been disconnected from the shaft 528 (with the sleeve 604 engaging the male spline member 524 and supporting the upper internal blowout preventer 522).

The legs 516 are telescoping legs providing length adjustability. Lower leg parts 516*b* move within and extend from upper leg parts 516*a* (see, e.g., FIGS. 5A, 5C) (although it is within the scope of the present invention to use solid non-telescoping legs).

Stabbing guide halves 533 and 535 facilitate centering of a tubular in the system.

Figure 5E:
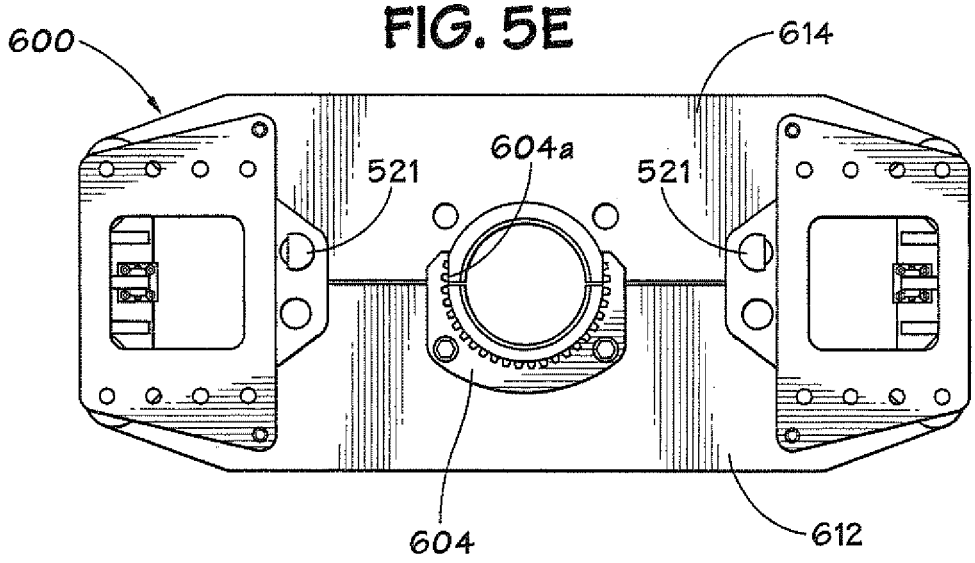
FIG. 5E is a top view of the part of FIG. 5A.
Figure 5F:
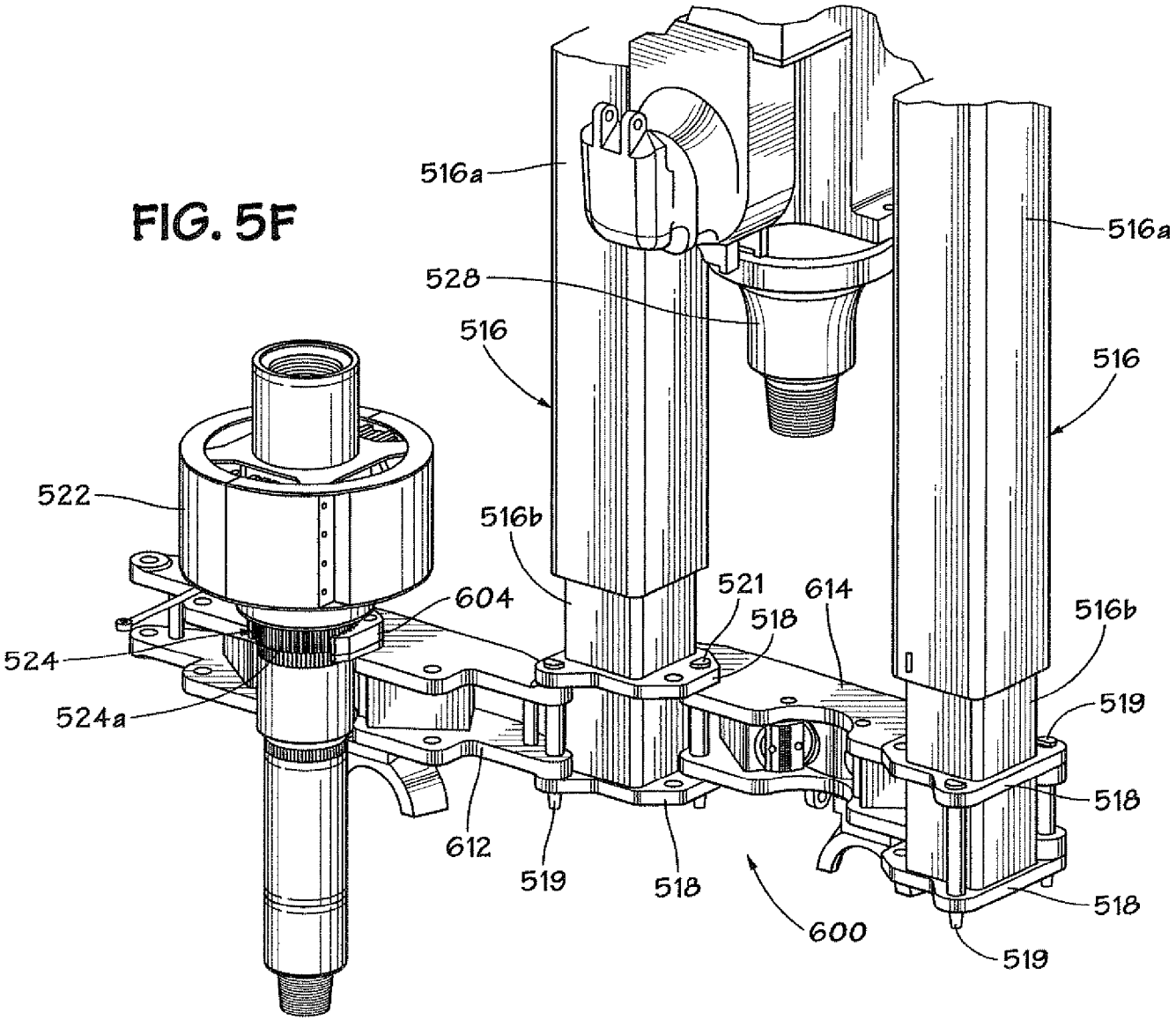
FIG. 5F is a perspective view of part of the system of FIG. 5A.
Figure 5G:
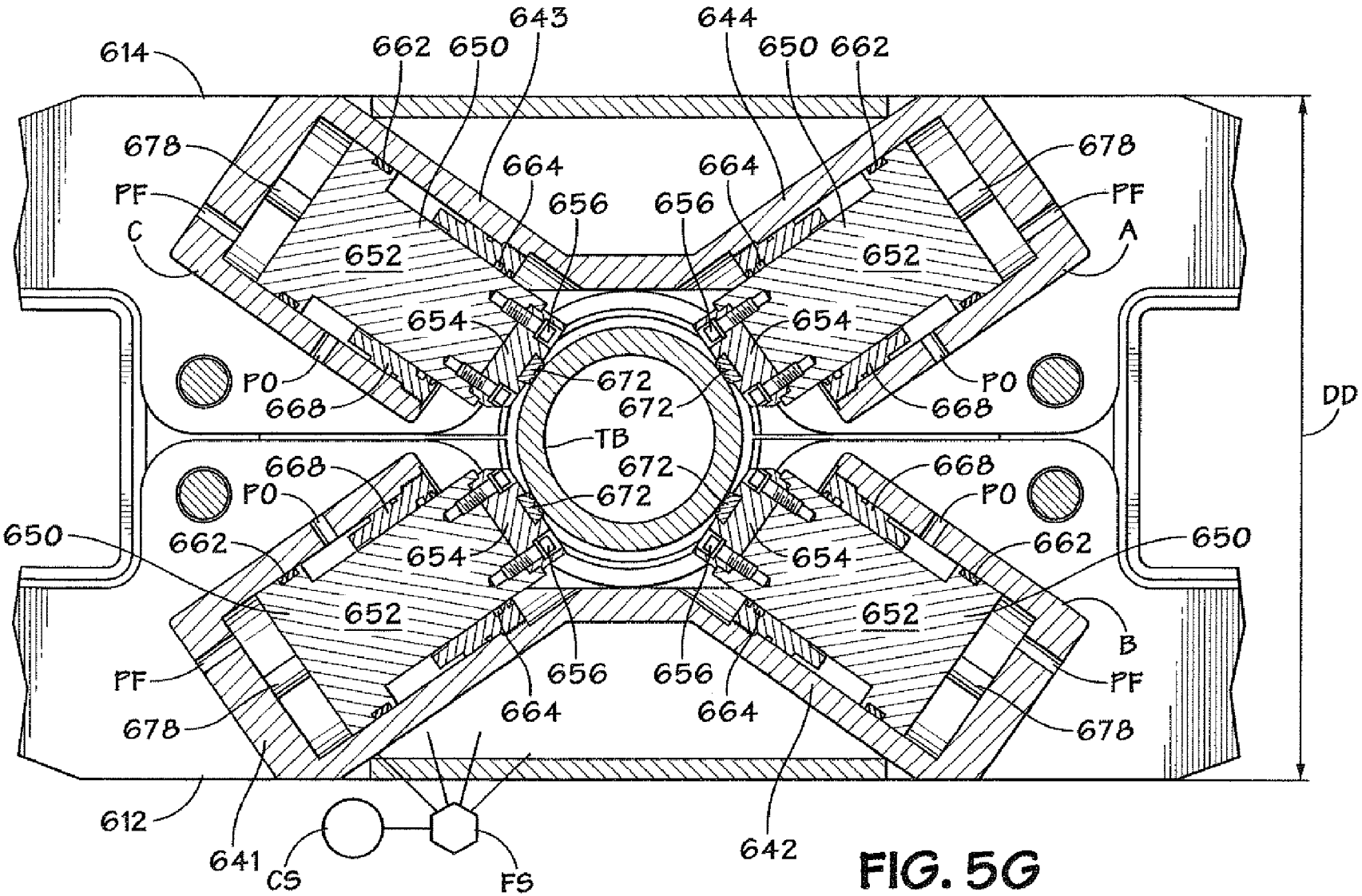
FIG. 5G is a top cross-section view of part of the system of FIG. 5A.

FIG. 5G shows a part of the interior of the tubular gripper system 600. Each half 612, 614 has two gripper housings, housings 641, 642 (half 612) and housings 643, 644 (half 614). A gripper 650 is movably disposed in each housing 641-644.

Each gripper 650 includes a movable piston 652 with a die carrier 654 bolted thereto with bolts 656. A seal 662 seals a housing/piston interface and a seal 664 seals a mount/piston interface between a mount 668 and the piston 652. Each die carrier 654 has a die 672 secured thereto. Each housing 641-644 has fluid ports PF and PO for providing fluid under pressure to move the pistons 652 to move the dies 672 into and out of engagement with a tubular TB to be gripper by the tubular gripper system 600. The pistons 652 move on shafts 678.

As shown in FIG. 5G, each piston 652 has been moved so that its corresponding die 672 has engaged the tubular TB, gripping the tubular TB in the center of the tubular gripper system 600. With an appropriate control system CS, fluid under pressure from a fluid source FS (e.g. hydraulic or pneumatic fluid) is applied to the pistons 652. This can be done so that the pistons 652 move in unison simultaneously, or not.

Figure 5H:
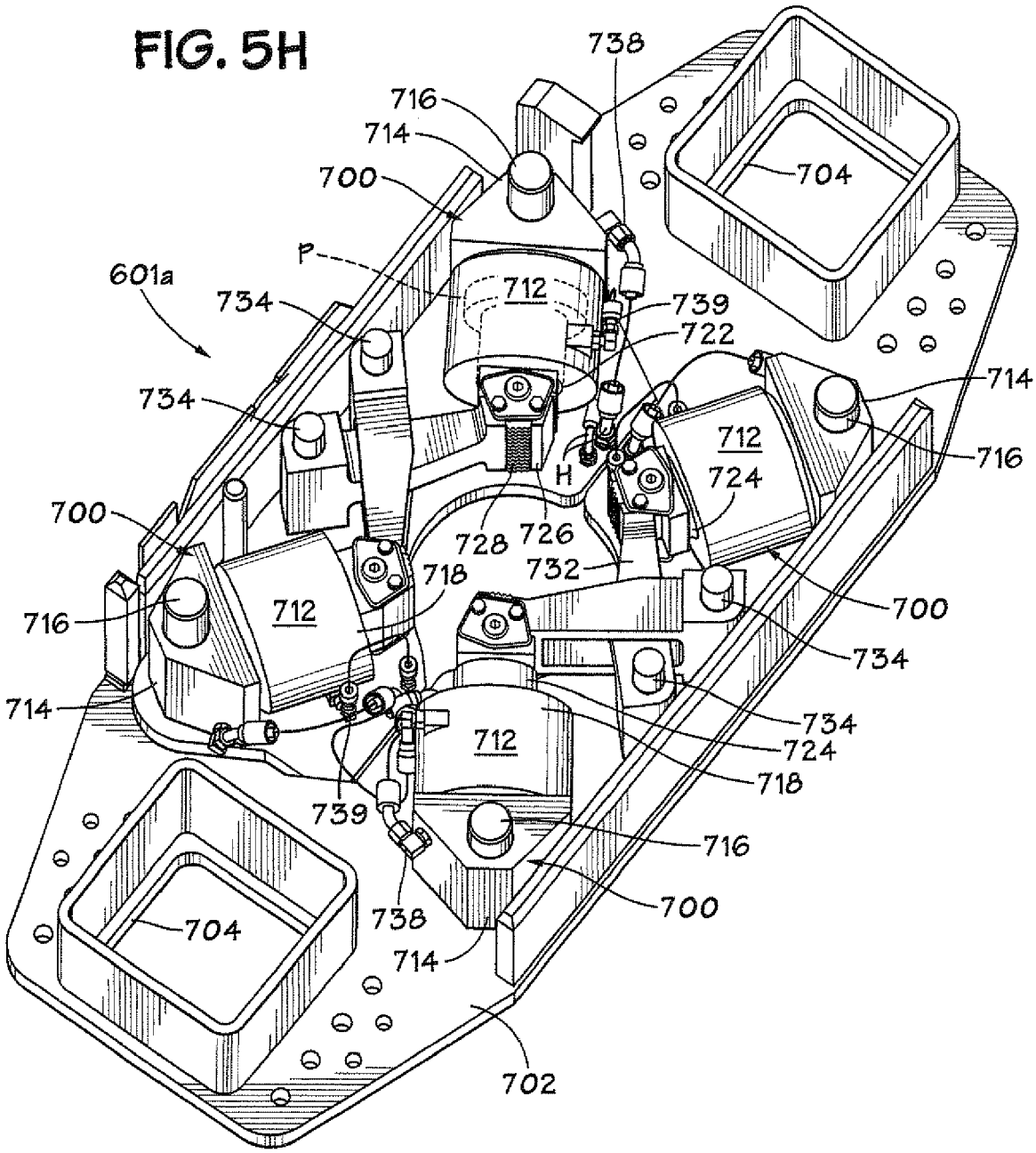
FIG. 5H is a top cutaway view of part of a gripper system according to the present invention.

FIG. 5H shows an alternative structure of the system 600 for moving four grippers into engagement with a tubular. Four grippers 700 are mounted to a housing 702. The housing 702 has openings 704 for receiving lower portions of support legs (like the legs 516).

Each gripper 700 has a housing 712 with a first end 714 pivotably mounted to a pin 716. Each housing 712 has a second end 718 and an opening 722 through which projects a shaft 724. Each shaft 724 has a die carrier 726 (with a die 728) secured thereto.

An arm 732 extends from each die carrier 726. Each arm 732 has an end pivotably secured to the housing 702 with a pivot pin 734. Each shaft 724 is connected to an internal piston P (one shown in dotted line). Movement of the piston P moves the shaft 724 to move the die carriers 726 toward and away from a tubular in the center of the tubular gripper system 700. As the shafts 724 move, each arm 732 pivots about its corresponding pivot pin 734 and each gripper housing 712 pivots about its corresponding pin 716. Fluid under pressure to move the pistons P is provided through lines 738, 739.

FIG. 6 shows a system 800 according to the present invention which includes a gripper system 802 according to the present invention (any disclosed herein, e.g. the gripper system 100). Legs 804 connect the gripper system 802 to a rotation apparatus 810. Rotation of the rotation apparatus 810 rotates the gripper system 802 and a tubular around which the gripper system 802 is clamped. The legs 804 are shown as non-telescoping, but telescoping legs may be used.

The legs 516 in certain aspects are relatively more massive than legs like the legs 285 (FIG. 2A). In certain aspects the legs 516 are larger in cross-section than legs like the comparatively flat legs 285 and/or are longer than legs like the legs 285 and are made to be more massive to better react torque imposed on the gripper system supported by the legs.

The present invention, therefore, provides in some, but not in necessarily all, embodiments a top drive system with a top drive unit, and a tubular gripping system connected to and beneath the top drive unit.

The present invention, therefore, provides in some, but not in necessarily all, embodiments a top drive system with a top drive unit, and a pipe gripping system connected to and beneath the top drive unit, the pipe gripping system having a body, four grippers movably connected to the body, four piston/cylinder devices, one movably interconnected with each of the grippers, the piston/cylinder devices for moving the grippers to clamp a tubular, e.g., a pipe.

The present invention, therefore, provides in some, but not in necessarily all, embodiments a tubular gripping system which is connectible to and beneath a top drive unit, the tubular gripping system having a body, four grippers movably connected to the body, four piston/cylinder devices, one movably interconnected with each gripper, the piston/cylinder devices for selectively moving the grippers to clamp a tubular, e.g., a pipe. In such a gripping system the grippers may be moved in unison and simultaneously.

It is within the scope of the present invention to have four grippers equally spaced around an opening or throat for receiving a tubular (e.g. every ninety degrees). In another aspect it is within the scope of the present invention to have two adjacent grippers on opposite halves of a gripper system spaced-apart by an acute angle (see grippers A, B, FIG. 5E) and two grippers on the same half spaced-apart by an obtuse angle (see grippers A, C, FIG. 5E). With the positioning as shown in FIG. 5E, the dimension DD can be reduced and relatively less space can be occupied by a gripper system according to the present invention, in certain aspects facilitating positioning of such a system between support links.

The present invention, therefore, provides in some, but not in necessarily all, embodiments methods for gripping a tubular member beneath a top drive unit, the method including moving a portion of a tubular member into a tubular gripping system according to the present invention, the gripping system located beneath the top drive unit.

The present invention, therefore, provides in some, but not in necessarily all, embodiments a top drive system with a top drive apparatus, and a tubular gripping system connected to and beneath the top drive apparatus, the tubular gripping system having a body into which is receivable a tubular to be gripped, and four grippers for engaging a tubular to be gripped, the grippers movably connected to the body. The present invention, therefore, provides in some, but not in necessarily all, embodiments a top drive system with: a top drive apparatus; and a tubular gripping system connected to and beneath the top drive apparatus, the tubular gripping system having a body, a first gripper movably connected to the body, a second gripper movably connected to the body, a third gripper movably connected to the body, a fourth gripper movably connected to the body, a first piston/cylinder device movably interconnected with the first gripper, a second piston/cylinder device movably interconnected with the second gripper, a third piston/cylinder device movably interconnected with the third gripper, a fourth piston/cylinder device movably interconnected with the fourth gripper, and each piston/cylinder device for moving its respective gripper to clamp a tubular. Such a system may include one or some, in any possible combination, of the following: the first gripper is at a first angle to the second gripper, the first angle being an acute angle, and the first gripper is at a second angle to the third gripper, the second angle being an obtuse angle; the body of the tubular gripping system is a first half and a second half, the first half separable from the second half; and/or a spline member on the first half of the body, the spline member for mating with a corresponding spline member on another item.

The present invention, therefore, provides in some, but not in necessarily all, embodiments a tubular gripping system with a body into which is receivable a tubular to be gripped, and four grippers for engaging a tubular to be gripped, the grippers movably connected to the body. Such a system may include one or some, in any possible combination, of the following: wherein the tubular gripping system has the four grippers comprising a first gripper movably connected to the body, a second gripper movably connected to the body, a third gripper movably connected to the body, a fourth gripper movably connected to the body, a first piston/cylinder device movably interconnected with the first gripper, a second piston/cylinder device movably interconnected with the second gripper, a third piston/cylinder device movably interconnected with the third gripper, a fourth piston/cylinder device movably interconnected with the fourth gripper, each piston/cylinder device for moving its respective gripper to clamp a tubular; wherein the grippers are movable simultaneously or independently not in unison; wherein the first gripper is at a first angle to the second gripper, the first angle being an acute angle, and the first gripper is at a second angle to the third gripper, the second angle being an obtuse angle; wherein the body of the tubular gripping system has a first half and a second half, the first half separable from the second half; and/or wherein a spline member on the first half of the body, the spline member for mating with a corresponding spline member on another item.

The present invention, therefore, provides in some, but not in necessarily all, embodiments a method for gripping a tubular member beneath a top drive unit, the method including: moving a portion of a tubular member into a gripping system, the gripping system located beneath the top drive unit, the gripping system having a body into which is receivable a tubular to be gripped and four grippers for engaging a tubular to be gripped, the grippers movably connected to the body; and gripping the tubular member with the four grippers of the gripping system.

The present invention, therefore, provides in some, but not in necessarily all, embodiments methods with a tubular gripping system for holding a first member and facilitating disconnection of the first member from a second member, the first member threadedly connected to the second member, the tubular gripping system having a body with a primary splined structure thereon, the first member having a secondary splined structure, the method including: engaging the primary splined structure with the secondary splined structure; and thereby preventing rotation of the first member with respect to the tubular gripping system.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventor may rely on the Doctrine of Equivalents to determine and assess the scope of the invention and of the claims that follow as they may pertain to apparatus not materially departing from, but outside of, the literal scope of the invention as set forth in the following claims. All patents and applications identified herein are incorporated fully herein for all purposes. What follows are some of the claims for some of the embodiments and aspects of the present invention, but these claims are not necessarily meant to be a complete listing of nor exhaustive of every possible aspect and embodiment of the invention. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A top drive system comprising a top drive apparatus, wherein the top drive apparatus includes a main shaft and the top drive system further comprises an internal blowout preventer connected to the main shaft, a tubular gripping system connected to and beneath the top drive apparatus, the tubular gripping system having a body into which is receivable a tubular to be gripped, and four grippers for engaging a tubular to be gripped, the grippers movably connected to the body and, further comprising a primary spline member on the first half of the body, the primary spline member for mating with a corresponding spline member on another item and a secondary spline member on the internal blowout preventer corresponding to and mating with the primary spline member, and, lifting apparatus for raising the tubular gripping system with respect to the secondary spline member to engage the primary spline member with the secondary member to facilitate breaking of a connection between the internal blowout preventer and the main shaft, the tubular gripping system for supporting the internal blowout preventer disconnected from the main shaft, and the first half movable away from the second half so that the internal blowout preventer is removable from the gripper system.

2. A top drive system according to claim 1, the tubular gripping system having,

A first gripper movably connected to the body, a second gripper movably connected to the body, a third gripper movably connected to the body, a fourth gripper movably connected to the body, a first piston/cylinder device for moving the first gripper, a second piston/cylinder device for moving the second gripper a third piston/cylinder device for moving the third gripper, a fourth piston/cylinder device for moving the fourth gripper, and each piston/cylinder device for moving its respective gripper to clamp a tubular.

3. The top drive system of claim 2 wherein the first gripper is at a first angle to the second gripper, the first angle being an acute angle, and the first gripper is at a second angle to the third gripper, the second angle being an obtuse angle.

4. The top drive system of claim 2 wherein the body of the tubular gripping system comprises a first half and a second half, the first half separable from the second half.

5. A tubular gripping system integral with a rotary top drive comprising a body into which is receivable a tubular to be gripped beneath a top-drive rotary drill rig, four grippers for engaging a tubular to be gripped, the grippers movably connected to the body, the four grippers comprising a first gripper movably connected to the body, a second gripper movably connected to the body, a third gripper movably connected to the body, a fourth gripper movably connected to the body, a first piston/cylinder device movably interconnected with the first gripper, a second piston/cylinder device movably interconnected with the second gripper, a third piston/cylinder device movably interconnected with the third gripper, a fourth piston/cylinder device movably interconnected with the fourth gripper, and each piston/cylinder device for moving its respective gripper to clamp a tubular.

6. The tubular gripping system of claim 5 wherein the grippers are movable simultaneously.

7. The tubular gripping system of claim 5 wherein the first gripper is at a first angle to the second gripper, the first angle being an acute angle, and the first gripper is at a second angle to the third gripper, the second angle being an obtuse angle.

8. The tubular gripping system of claim 5 wherein the body of the tubular gripping system comprises a first half and a second half, the first half separable from the second half.

9. The tubular gripping system of claim 8 further comprising a primary spline member on the first half of the body, the primary spline member for mating with a corresponding spline member on another item.

10. A method for gripping a tubular member beneath a top drive unit, the method comprising moving a portion of a tubular member into a gripping system, the gripping system located beneath the top drive unit, the gripping system having a body into which is receivable a tubular to be gripped and four grippers for engaging a tubular to be gripped, the grippers movably connected to the body, and gripping the tubular member with the four grippers of the gripping system wherein the top drive unit has a main shaft and an internal blowout preventer is connected to the main shaft, the internal blowout preventer has a secondary spline member, the body of the gripping system has a primary spline member, the method further comprising mating the primary spline member with the secondary spline member, and, wherein the tubular gripping system includes lifting apparatus for raising the tubular gripping system with respect to the secondary spline member to engage the primary spline member with the secondary spline member to facilitate breaking of a connection between the internal blowout preventer and the main shaft, the method further comprising lifting the tubular gripping system so that the primary spline member engages the secondary spline member, and breaking the connection between the internal blowout preventer and the main shaft, and, wherein the tubular gripping system is for supporting the internal blowout preventer disconnected from the main shaft, and the first half movable away from the second half so that the internal blowout preventer is removable from the gripper system, the method further comprising moving the first half away from the second half while the first half is supporting the internal blowout preventer, and moving the internal blowout preventer away from the first half.

11. A method, with a tubular gripping system beneath a top drive unit, for holding a first member and facilitating disconnection of the first member from a second member, the first member threadedly connected to the second member, the tubular gripping system having a body with a primary splined structure thereon, the first member having a secondary splined structure, the method comprising:

engaging the primary splined structure with the secondary splined structure, and thereby preventing rotation of the first member with respect to the tubular gripping system wherein the top drive unit has a main shaft and an internal blowout preventer is connected to the main shaft, the internal blowout preventer has a secondary spline member, the body of the gripping system has a primary spline member, the method further comprising mating the primary spline member with the secondary spline member, and, wherein the tubular gripping system includes lifting apparatus for raising the tubular gripping system with respect to the secondary spline member to engage the primary spline member with the secondary spline member to facilitate breaking of a connection between the internal blowout preventer and the main shaft, the method further comprising lifting the tubular gripping system so that the primary spline member engages the secondary spline member, and breaking the connection between the internal blowout preventer and the main shaft, and, wherein the tubular gripping system is for supporting the internal blowout preventer disconnected from the main shaft, and the first half movable away from the second half so that the internal blowout preventer is removable from the gripper system, the method further comprising moving the first half away from the second half while the first half is supporting the internal blowout preventer, and moving the internal blowout preventer away from the first half.

* * * * *